United States Patent [19]

Herbert Tang

[11] 3,947,678

[45] Mar. 30, 1976

[54] FLUORESCENT LANTERN

[76] Inventor: Wing-Hing Herbert Tang, 326, Kwun Tong Road, Kwun Tong, Kowloon, Hong Kong

[22] Filed: Oct. 15, 1974

[21] Appl. No.: 514,792

[52] U.S. Cl. ..... 240/11.4 R; 240/51.11 R
[51] Int. Cl.[2] ..... F21L 3/00
[58] Field of Search .... 240/11.4 R, 51.11 R, 11.2 R

[56] References Cited

UNITED STATES PATENTS

| | | | |
|---|---|---|---|
| 2,413,599 | 12/1946 | Beck | 240/11.4 R |
| 2,435,164 | 1/1948 | Sobel | 240/11.4 R |
| 2,492,837 | 12/1949 | Briggs | 240/11.4 R |
| 3,283,144 | 11/1966 | Rogers | 240/51.11 R |
| 3,331,958 | 7/1967 | Adler | 240/51.11 R |
| 3,435,206 | 3/1969 | Swanson | 240/11.4 R |
| 3,604,920 | 9/1971 | Niles | 240/11.2 R X |

*Primary Examiner*—Robert P. Greiner
*Attorney, Agent, or Firm*—Friedman & Goodman

[57] ABSTRACT

A fluorescent lantern includes a tubular extruded body portion closed with two covers at the respective opposite ends, one of which is removably mounted. A planar reflector, which extends along the length of the enclosure proximate to a curved side in the form of a lens, includes a tab at one end thereof to which the collector tab of an output transistor is mounted, the reflector tab acting as a heat sink for maintaining the output transistor at a low operating temperature. A fluorescent bulb extends along the length of the enclosure and is disposed between the curved lens and the reflector to enhance the amount of light transmitted through the lens. Electrical terminals and a switch are connectable to a source of direct voltage, either external or to batteries housed within the enclosure, and a circuit is disposed within the enclosure for converting the direct voltage into an alternating voltage suitable for energizing the fluorescent bulb when applied across the latter. Electrical contacts are provided for facilitating removal of the cover by completing and interrupting the electrical continuity between the switch and the circuit means when the cover is respectively mounted and removed from the enclosure. The circuit means is controlled by the switch in the mounted condition of the cover. In this manner, the bulb may be energized and light emitted through the lens when the terminals are connected to a source of electrical energy and the switch is moved to the actuating position thereof.

18 Claims, 5 Drawing Figures

FLUORESCENT LANTERN

BACKGROUND OF THE INVENTION

The present invention relates to portable lighting means, and more specifically to a fluorescent lantern which is compact, simple in construction and economical to manufacture.

Conventional flashlights are known which include tubular body members dimensioned to receive storage batteries therein. Flashlights of the type commonly used employ a parabolic-type reflector and an incandescent light bulb disposed in the region of the focus of the parabolically shaped reflector to thereby generate, to the extent possible, a narrow beam of light when the bulb is energized.

It is often desirable, however, to light a given area with other than a narrow beam of light. For example, lanterns are frequently utilized in camping applications for lighting the interior of tents. Many lanterns of the known type for the use in this application utilize a source of fuel for generating light. For example, gas, turpentine and other fuels have been used to light lanterns used in lighting an entire area. However, many lanterns of this type generate a hot flame and this represents a danger insofar as starting a fire is concerned. Additionally, the lanterns with the hot flame generate a light which is not similar to daylight. Further, many of the known lanterns are made from metallic parts which are expensive to manufacture and add weight to the lantern which makes it less convenient to carry around on trips, such as a camping trip.

SUMMARY OF THE INVENTION

It is an object of the present invention to provide a fluorescent lantern which is not possessed of the above described disadvantage inherent in prior art comparable lanterns.

It is another object of the present invention to provide a fluorescent lantern which is simple in construction and economical to manufacture.

It is still another object of the present invention to provide a fluorescent lantern which includes a housing or body which is formed from a section of extruded plastic material.

It is yet another object of the present invention to provide a lantern as suggested in the last-mentioned object which is light in weight and easily transportable.

It is a further object of the present invention to provide a fluorescent lantern which emits fluorescent light over a relatively large area as opposed to a beam of light as common with prior art flashlights.

It is still a further object of the present invention to provide a fluorescent lantern of the type under discussion which is easily assembled and disassembled to change the fluorescent bulb, storage batteries or maintain the lantern.

It is still a further object of the present invention to provide a fluorescent lantern as in the last-mentioned object wherein all the electrical elements and circuitry are also removable from the housing for maintenance and repair.

It is an additional object of the present invention to provide a fluorescent lantern which includes means for connection to an external source of direct voltage, as well as including means for connection to storage batteries contained within the enclosure or housing of the lantern.

It is yet an additional object of the present invention to provide a fluorescent lantern which includes an electrical circuit for converting a direct voltage into an alternating voltage suitable for energizing a fluorescent bulb or lamp, the circuit including an output transistor having a collector tab, and wherein an elongate planar reflector is provided having a tab at one free end thereof to which the collector tab is connected to thereby remove heat from the collector tab and act as a heat sink to the output transistor.

In order to achieve the above objects, as well as others which will become apparent hereafter, a fluorescent lantern in accordance with the present invention comprises an at least partially transparent elongate enclosure having an open end. A cover is removably mounted on said enclosure to cover the open end when mounted on the enclosure. Reflector means is provided extending along the length of said enclosure proximate the transparent portion thereof and a fluorescent bulb extends along the length of said enclosure and disposed between the transparent portion and said reflector whereby the latter enhances the amount of light transmitted through said transparent portion. Electrical terminal means is provided on said cover connectable to a source of direct voltage and a switch is similarly mounted on said cover and connected to said electrical terminal means. Circuit means, which is disposed within said enclosure, is provided for converting a direct voltage into an alternating voltage suitable for energizing said fluorescent bulb when applied across the latter. Electrical contact means is provided for completing and interrupting the electrical continuity between said switch and said circuit means when said cover is respectively mounted and removed from said enclosure. In this manner, said circuit means is controlled by said switch in the mounted condition of said cover to thereby permit energization of said bulb and emission of light through said transparent portion when said terminal means is connected to a source of electrical energy and said switch is moved to the actuating position thereof.

According to an important feature of the present invention, said circuit means includes an output transistor connected to said fluorescent bulb and has a metallic collector tab. Said reflector means is in the form of an elongate planar metallic member having a tab at one free end thereof, said collector tab being mounted on said reflector tab to thereby cause the latter to serve as a heat sink for removing heat from the output transistor and maintaining the same at a safe operating temperature.

According to another important feature of the present invention, a substantial part of said enclosure forms a portion of an extruded section of elastomeric material. Covers provided to close the opposing open ends, as well as the enclosure, are made of a plastic material which results in a simple and lightweight construction.

A housing, receivable within said enclosure houses the electrical circuit, the reflector being connected to the housing and being removable from said enclosure therewith. Contact portions within said cover and at the free end of the reflector are aligned and electrically engaged when the cover is mounted on said enclosure to provide electrical continuity between the electrical terminals and the switch and the circuit. When said cover is removed, said reflector and said housing is fully removable from said enclosure for changing bulbs, storage batteries, or repairing the lantern.

BRIEF DESCRIPTION OF THE DRAWINGS:

With the above and additional objects and advantages in view, as will hereinafter appear, this invention comprises the devices, combinations and arrangements of parts hereinafter described by way of example and illustrated in the accompanying drawings of a preferred embodiment.

DESCRIPTION OF THE PREFERRED EMBODIMENTS

Figure 1:
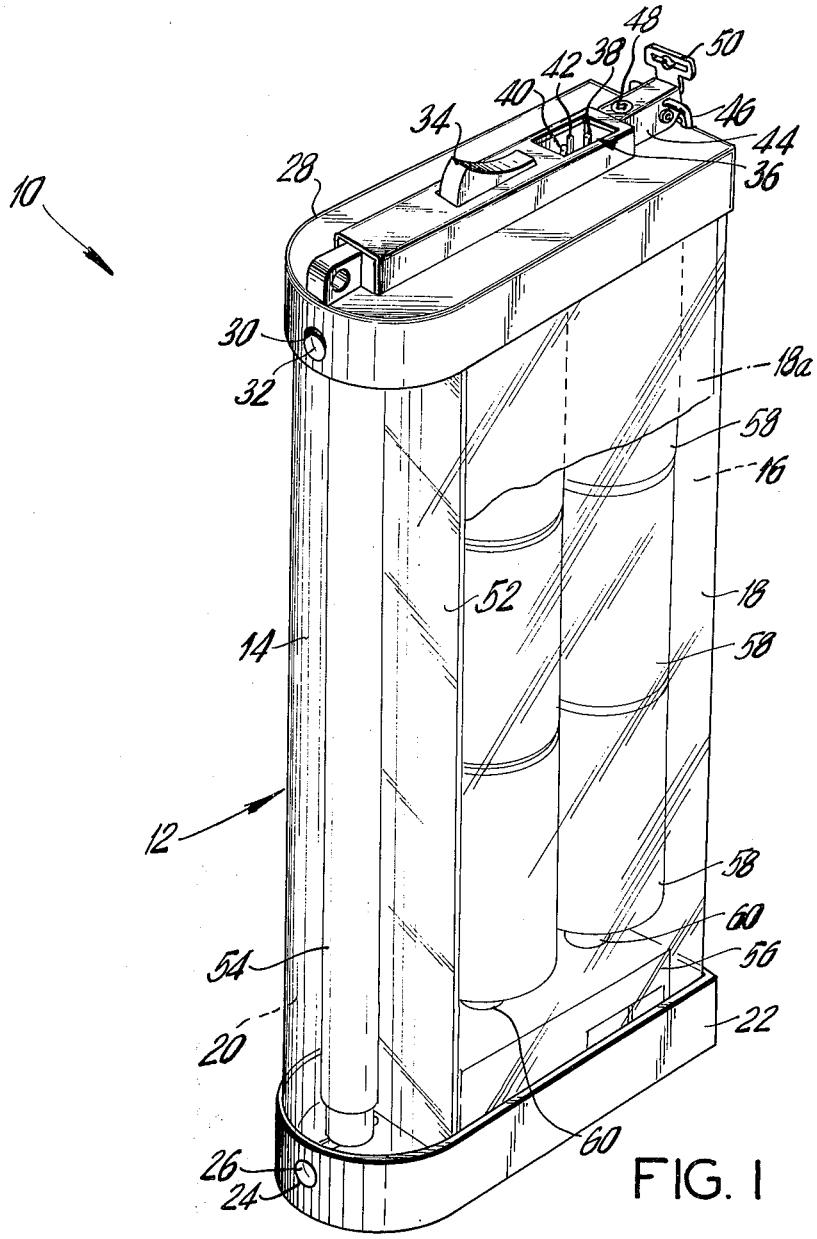
FIG. 1 is a perspective view of a fluorescent lantern in accordance with the present invention, showing a portion of an internal covering lining broken away to show the manner in which the storage batteries are housed within the enclosure.

Referring now to the figures, wherein identical or similar parts are designated by the same reference numerals throughout, and first referring to FIG. 1, there is shown the fluorescent lantern in accordance with the present invention which is generally designated by the reference numeral 10.

Figure 3:
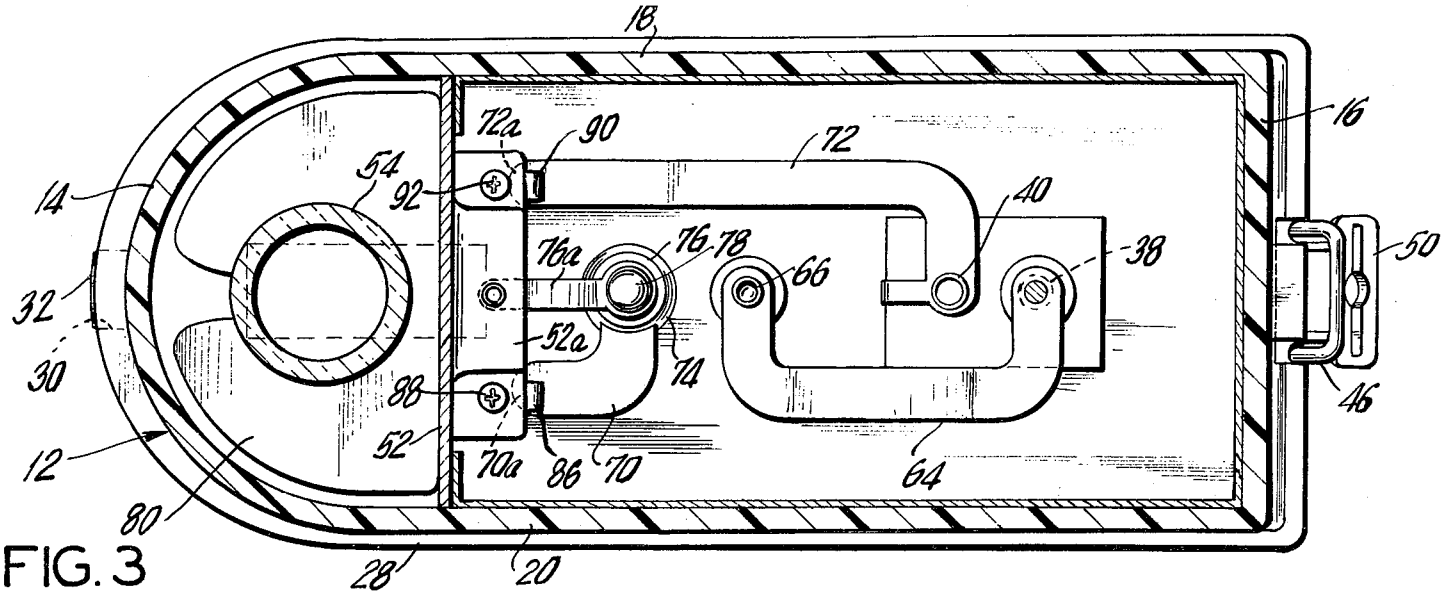
FIG. 3 is a cross sectional view of the lantern taken through line 3—3 of FIG. 2.

The lantern 10 generally includes a transparent elongate housing or enclosure 12 having a curved front wall 14 having a circular cross section and in the form of a convex lens, as best shown in FIG. 3. A flat rear wall 16 is spaced from and in opposition to the curved front wall 14. A pair of opposing flat sidewalls 18 and 20 extend between the front and rear walls. The lantern housing or enclosure 12 generally has a uniform cross section along the length thereof and is advantageously made from an extruded section of tubing of elastomeric material. For example, the enclosure 12 may comprise a length of extruded tubing having the cross section shown in FIG. 3 and made from a light transmissive or transparent material such as Plexiglass or other acrylic material.

In the presently preferred shape of the housing or enclosure 12, the cross section has two opposing parallel portions representing the sidewalls 18 and 20 which have a predetermined length as viewed in FIG. 3. A transverse portion representing the rear wall extends between the two parallel portions at one end of the latter and has a length less than the predetermined length of the sidewalls. The outwardly curved portion associated or representing the front wall 14 extends between the two parallel portions at the other end of the same to form a convex lens along one side of the enclosure. As will be evident from the description that follows, at least the convex lens or front wall 14 is transparent and represents the wall through which the light generated by the lantern is transmitted.

While the sidewalls 18 and 20 and the rear wall 16 are similarly transparent in the presently described embodiment, it is possible for the sidewalls and rear wall to be opaque so as to conceal the electric components, to be described, which are housed within the enclosure 12. When the enclosure 12 is extruded in the above suggested manner, an alternative to making the wall 16, 18 and 20 opaque is to utilize a cover lining **18*a*** which closely follows the interior surfaces of the last-mentioned walls.

The extruded housing or enclosure 12 has one end thereof closed by a end or lower cover 22 provided with a frontal aperture 24 through which a nipple 26 formed on the curved wall 14 may be received. With the lower peripheral skirt or edges of the enclosure 12 received within the bottom cover 22, the latter is advantageously connected to the enclosure 12 by suitable adhesive means so that the cover 22 becomes permanently fixed or attached to the enclosure.

An upper or top cover 28 is generally similarly configurated as the bottom cover 22 and is removably mounted on the top of the enclosure 12 for closing or exposing the upper opening in the enclosure. The top cover 28 is similarly provided with an aperture 30 through which a corresponding nipple 32 on the curved front wall 14 is receivable for connecting the cover to the housing or enclosure in the manner to be described hereafter.

Figure 2:
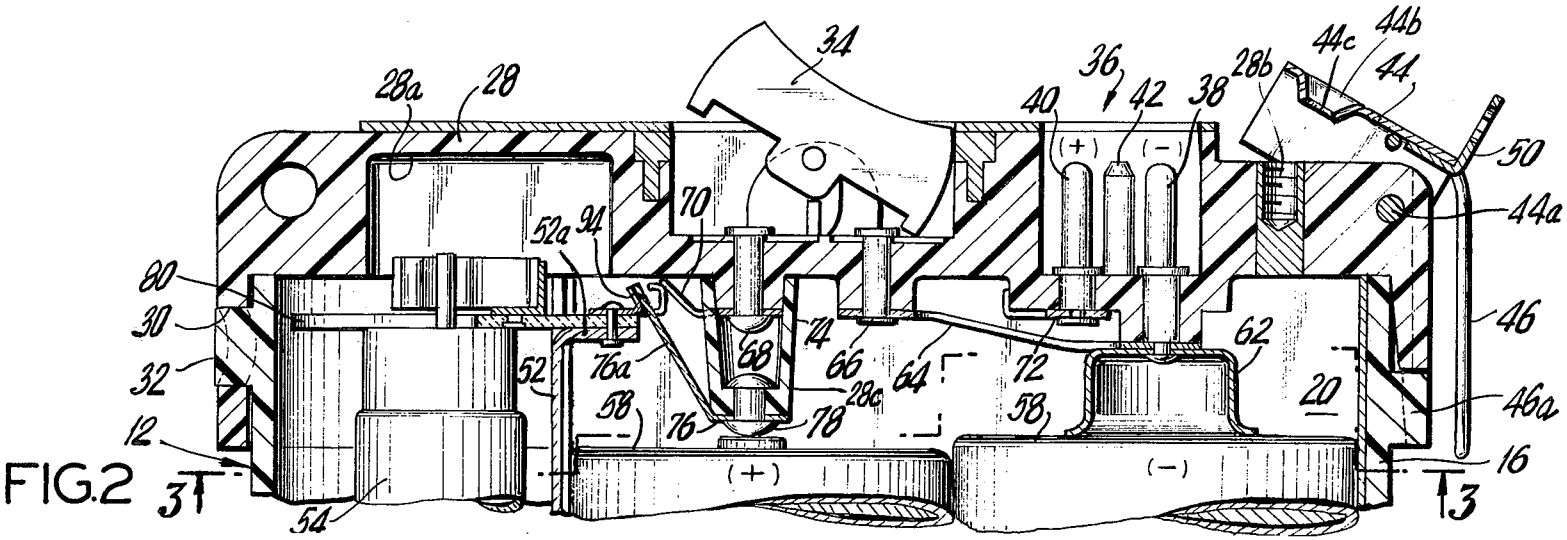
FIG. 2 is an enlarged cross sectional view taken longitudinally through the top cover of the lantern shown in FIG. 1, showing the locking lever in a raised position for unlocking and separating the cover from the enclosure.

Referring to FIGS. 1 and 2, the top cover 28 is shown provided with a toggle switch, in the form of a single-pole, single-throw switch 34 and a recess for defining an external power receptacle in the nature of a male power connector 36. Provided in the recess, are a pair of pins 38 and 40 which are respectively the negative and positive electrical terminals which are connectable to a source of direct voltage by means of a complementary or mating female connector (not shown) receivable within the recess. To assure that the right polarity connection is made, a rib 42 is advantageously provided which permits insertion of the female connector in only one orientation which results in appropriate alignment of the pins 38, 40 into the corresponding polarity apertures on the female connector.

A locking lever 44 is provided which is pivotally mounted on the top cover 28 about a pin **44*a*, as shown in FIG. 2. Pivotally connected to the locking lever 34 is a locking loop 46, shown in FIGS. 1 and 3 whose closed lower end is movable upwardly and downwardly with relation to the top of the enclosure 12 as the locking lever 34 is pivoted from its upward or extended, open position shown in FIG. 2 to the closed or locking position shown in FIG. 1. A projection, nipple or protuberance 46*a* extends rearwardly from the upper portion of the rear wall 16 which is engageable by the lower closed end of the loop 46 when the locking lever 44 is moved to its downward or locking position. Thus, the closing of the upper open end of the enclosure 12 is achieved by first aligning the aperture 30 with the nipple 32 and causing the latter to extend through the former. The rear end of the top cover 28 is now lowered and, with the locking lever 44 in its upper or unlocked position, the lower closed end of the loop 46 is placed below the extension 46*a*. Locking is effected by depressing the locking lever 44 to its closed position shown in FIG. 1, this slightly elevating the closed lower end of the loop and causing the latter to abut against the projection 46***a* in pressure relation. A locking screw 48 prevents inadvertent opening of the locking lever 44 whereby the top cover 28 becomes securely fixed to the enclosure 12 by secure engagement with the nipple 32 and projection or extension 46*a*. Provisions for the screw 48 is made by providing a threaded aperture 28*b* in the top cover 28 and by providing a conical recess surface corresponding to the shape of the screwhead. A throughhole 44*c* in the locking lever 44 permits passage of the screw 48 for threaded engagement with the top cover 28.

Means, in the form of slotted tab 50 may be advantageously provided which permits a strap or other holding means to be connected thereto.

A reflector 52 is provided which extends along the length of the enclosure proximate to the front wall or lens 14. The reflector is in the form of a planar member which has dimensions corresponding to those of the rear wall 16 and extends between the other end of the parallel portions which correspond to the sidewalls 18, 20 where the latter are connected to the curved wall 14. The lens 14 and the planar reflector 15 together form an elongate compartment through which an elongate fluorescent bulb 54 extends, as best shown in FIGS. 1 and 3.

Electrical terminal means are provided which are connectable to a source of direct voltage. As above described, one set of electrical terminal means comprise a pair of male pin connectors accessible on the front cover 28 when the latter is mounted on the enclosure. As to be described hereafter, the source of D.C. voltage may be applied through toggle switch 34 to an electrical circuit which is housed within a housing 56 disposed within the lower region of the enclosure 12. Further electrical terminal means are provided which are connectable to electrical storage batteries 58 which are housed within the enclosure 12 and represents an internal source of direct electrical voltage. For this reason, the lantern 10 is portable and may be utilized as are other lanterns in areas where there is no ready source of electrical energy. The terminal means for making contact with the electrical poles of the storage batteries 58 include terminals or contacts 60 mounted on the upper surface of the housing 56 and an electrical contact 62, shown in FIG. 2, which is connected to the negative pin 38 of the external power receptable 36.

As best shown in FIGS. 2 and 3, the negative battery contacts 62 and the negative pin 38 are connected by means of a strap 64 to one terminal 66 of the toggle switch 34, the other terminal 68 of the switch being connected to a strap 70 whose further connection is to be described hereafter.

The other electrical terminal in the upper region of the enclosure 12 is the terminal or contact 78 which is in the nature of a rivet mounted or supported at the lower end of a standoff or spacer 28*c*. As shown in FIG. 2, the electrical contact 62 is in the nature of a cylindrical member having a flared edge which is suitable for abutting against the planar negative contact of a storage battery. On the other hand, the terminal 78 is smaller and provided with a rounded head suitable for abutting against the smaller positive terminal of a storage battery. The terminals 60 are advantageously resiliently mounted and may, within limited degrees, move towards and away from the top cover 28 to assure good contact with the battery terminals without applying excessive forces against the terminals 62 and 78 or the cover 28.

Figure 4:
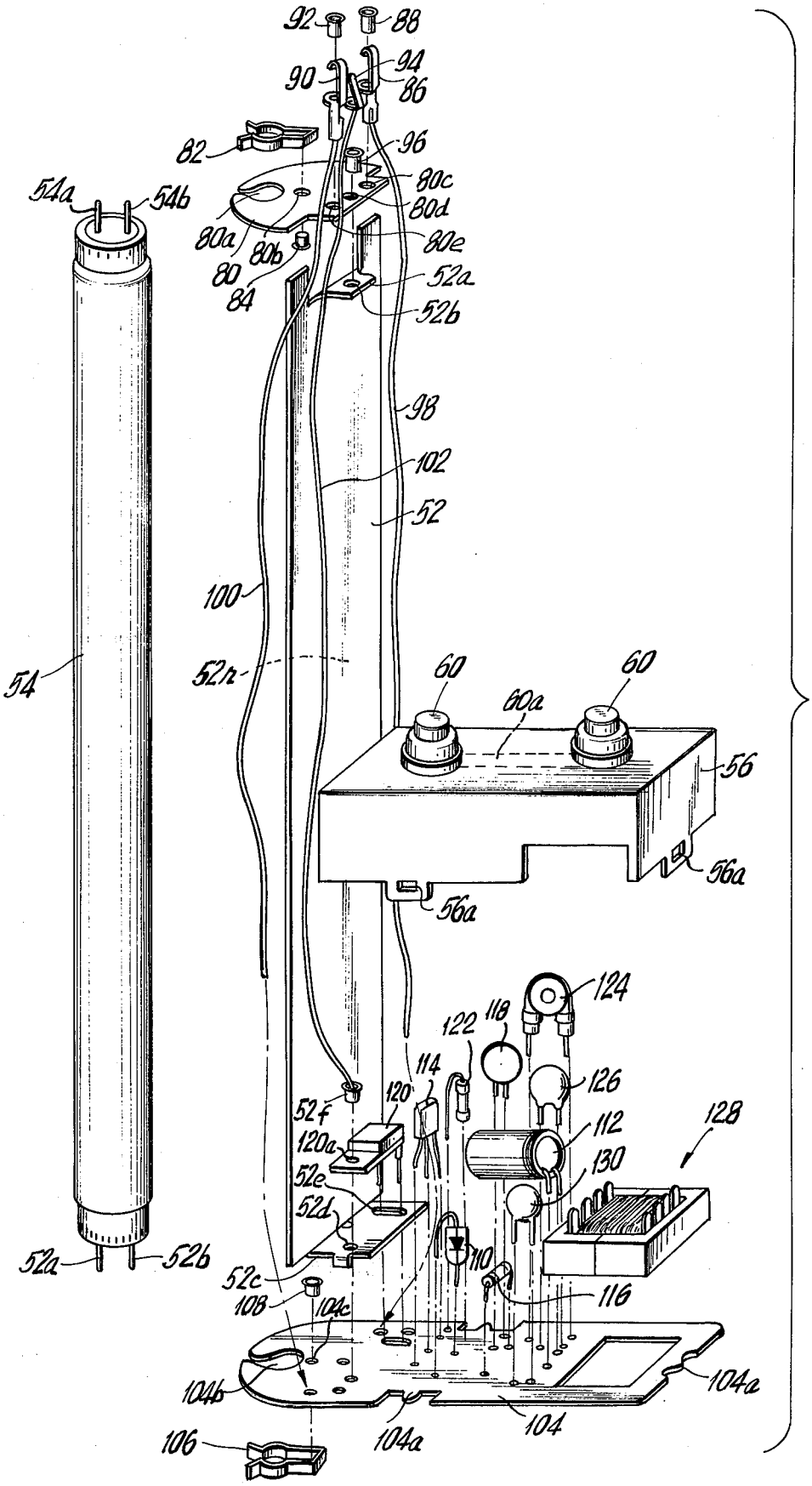
FIG. 4 is an exploded view of the electrical circuit, the reflector, and the electrical wiring connecting the lamp to the electrical circuit, including the contacts for connection of the electrical circuitry to the switch and electrical terminals in the top cover of the lantern.

The terminals 60 are shorted or connected to one another by means of a shorting strap 60*a*, shown in dashed outline in FIG. 4 so that the total direct series voltage represented by the storage batteries 58 is applied across the terminals 62 and 78. As above described, the negative terminals 38 and 62 are connected to the strap 70 by means of the switch 34. The positive terminal 78 is connected to a conductor 76 which has a projection, tab or extension 76*a* whose function will be described hereafter. On the other hand, the positive pin 40 is connected to a conductor or strap 72 which extends towards the reflector 52, as shown in FIG. 3. The free end or contact portion 72*a* of the strap 72, the projection or tab 76*a* which also serves as a contact portion and the contact portion 70*a* of the strap 70 all extend to substantially equal proximity of the reflector 52 as shown in FIG. 3. These contact portions serve to complete and interrupt the electrical continuity between the switch 34 and the electrical contacts and the circuit means, to be described, when the cover 28 is respectively mounted and removed from the enclosure 12.

A transverse support member or plate 80 made out of electrically insulating material is provided at one or top free end of the reflector 52, the latter being in the nature of a planar metallic member provided with a rearwardly extending tab 52*a*. The support member or plate 80 is connectable to the tab 52*a* by means of a rivet 96 which passes through a central aperture 80*d* in the support member 80 and an aperture 52*b* in the tab 52*a*.

A cutout portion 80*a* is provided in the frontal region of the support member 80 for successively receiving the pins 54*a* and 54*b* of the bulb or lamp 54 and for permitting the pins to be reoriented in a substantially transverse position to the original direction of entry for the purpose of being securely gripped by a lamp clip 82 which is fixed or connected to the support member 80 by means of a rivet 84 which extends through an aperture 80*b*.

A further pair of apertures 80*c* and 80*e* are provided on each side of the aperture 80*d*. The aperture 80*c* serves to anchor a spring contact or contact portion 86 by means of a rivet 88 which passes through the aperture 80*c*. Similarly, the aperture 80*e* serves to anchor or secure a spring contact or contact portion 90 by means of a rivet 92 which extends through the aperture 80*e*.

A spring contact or contact portion 94 is mounted on the support member 80 by means of the rivet 96 which extends through the aperture 80*b* as above described. The spring contact or contact portions 86, 90 and 94 are positioned and spaced from each other on the support member 80 so that the same are aligned with the free ends or contact portions 72*a*, 70*a* and 76*a* in electrical abutting contact therewith when the cover 28 is mounted on the enclosure 12.

The reflector 52 is provided with a reflective side 52*r* which faces the curved front wall 14 to optimize the amount of light transmitted through the front wall or lens 14. In a presently preferred embodiment, the reflector is made from a metal, such as tin, and is provided with a polished surface 52*r* which may be coated with a layer or deposit of chromium.

The spring contact 86 is connected by means of a conductor or lead 98 to the electrical circuit to be described. Similarly, the spring contacts 90 and 94 are connected to the electrical circuit by means of conductors or leads 100 and 102. It will thus be noted, that the transverse support member 80 is provided at one free end of the reflector 52. A transverse circuit board 104 is provided at the other free end of the reflector 52. The support member 80 and at least a support portion of the circuit board 104 extend into the elongate bulb compartment above described and are provided with means, namely clips 82 and 106, for supporting the fluorescent bulb 52.

The printed circuit board 104 has electrical components mounted thereon, as to be described, on that portion of the board which is on the other side of the reflector 52 with respect to the bulb support portion. The lamp clip 106, and the cutout portion 104*b* are adapted to receive the bulb pins 52*a* and 52*b* similarly as are the clip 82 and the cutout portion 80*a*.

An important feature of the present invention is that the lower end of the reflector 52 is provided with a rearwardly directed tab 52*c* which has an aperture 52*d* and a slot 52*e*. An output transistor 120 has a collector tab 120*a* which is apertured and is connected to the tab 52*c* by means of a rivet 52*f* which passes through the aperture in the tab 120*a* and the aperture 52*d* in the tab 52*c*. The emitter and collector leads of the transistor 120 pass through the aperture or slot 52*e* for connection to the printed circuit board 104.

With the rivets 96 and 52*f* in place, it becomes clear that the reflector 52, the support member 80 and the printed circuit board 104 become one unit which may be inserted into and withdrawn from the enclosure 12. When the above described assembly is inserted into the enclosure 12, the spring contacts or contact portions 86, 90 and 94 are in aligned positions to engage the contact portions or free ends 70*a*, 72*a* and 76*a* when the cover is mounted on the enclosure.

Figure 5:
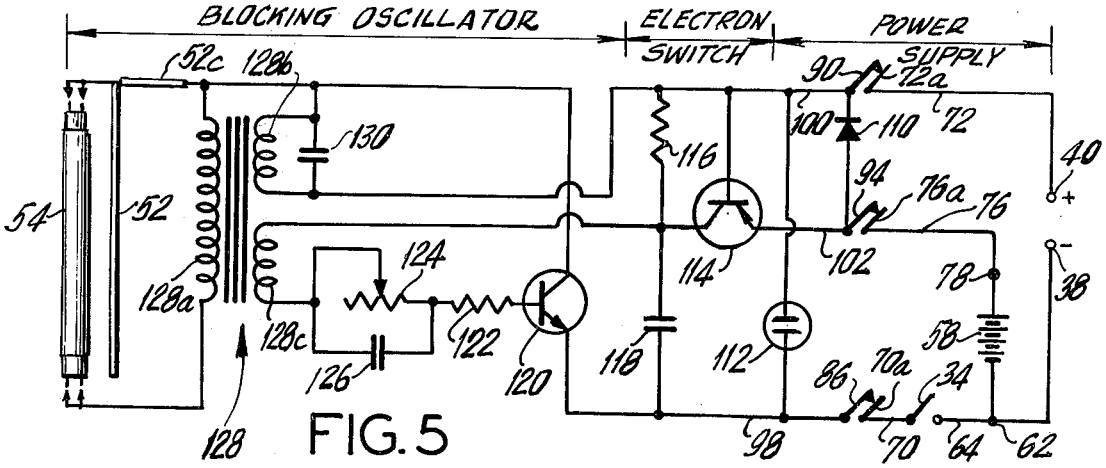
FIG. 5 is an electrical schematic of the electrical circuit utilized in the present invention for converting a source of D.C. voltage into an alternating voltage suitable for energizing the fluorescent bulb when the top cover is mounted on the enclosure and the circuit is connected to a source of electrical energy by means of the switch in the top cover.

The housing 56 is receivable within the enclosure 12, as above described, for enclosing the electrical circuit, represented by the schematic in FIG. 5.

The printed circuit board 104 is provided with detents 104*a* one distributed on each side and rear edges of the board and the housing 56 is provided with downwardly projecting gripping portions provided with apertures 56*a* dimensioned to receive the detents 104*a*. When the housing 56*a* is made of a plastic material which is somewhat flexible, the gripping portions may be snapped over the detents to engage the same and form a cavity or enclosure which houses and protects the electrical components to be described.

With specific reference to FIGS. 4 and 5, the electrical terminals 38 and 40 are shown in FIG. 5. The negative terminal 38 is connected by means of a strap 64 to the switch 34. All these elements are provided on the cover 28. The electrical storage batteries 58 are shown connected between the contacts 62 and 78. The contact 62 is connected to the switch 34 by means of strap 64. Thus, the common or ground terminals of both the internal supply and the external source are each connected in series with the on/off switch 34 provided on the cover 28.

The positive pin 40 is connected by means of strap 72 and contact portion 72*a* to spring contact or contact portion 90 above described. Similarly, the positive terminal 78 of the battery is connected by means of conductor 76 and contact portion or supporting contact 76*a* to spring contact or contact portion 94. The switch 34 is itself connected by means of strap 70 and spring or contact portion 70*a* to spring contact or contact portion 86. It is thus noted that the electrical circuit up to the spring contact or contact portions are disposed within the cover and represent the power supply portion of the circuit. A diode 110 is connected between the spring contacts 90 and 94 for preventing damage to the active elements in the circuit due to a wrong application of polarities to the pins 38 and 40.

As described above, the contact portion or spring contact 90 is connected by means of conductive lead 100 to one terminal of a filter or bypass capacitor 112, the other terminal of which is connected by means of lead 98 to the spring contact 86. The capacitor 112 is relatively large to prevent fluctuations and stray disturbances from effecting the operation of the circuit. The capacitor 112 as well as the diode 110 also form part of the power supply of the circuit.

A transistor 114 has its emitter connected to the leads 102 with the base thereof connected to the lead 100 and the collector thereof to a junction point or connecting point between a resistor 116 and a capacitor 118 which form a divider circuit extending between the leads 98 and 100. The transistor 114, the resistor 116 and the capacitor 118 form an electrical switch which triggers or pulses a blocking oscillator which follows. The resistor 116 and the capacitor 118 together determine the oscillating frequency of the electronic switch. However, the specific frequency or the nature of the electronic switch used is not critical for the purpose of the present invention, it being understood that other electronic switches may be utilized for this purpose.

The blocking oscillator, which drives the fluorescent bulb or lamp 54 includes an output transistor 120, which is in the nature of a power transistor which may dissipate a substantial amount of energy. For this reason, a transistor having a collector which can be directly heat sunk is utilized, such as shown in FIG. 4. As described above, the collector tab 120*a* is directly connected to the tab 52*c* of the reflector to remove excessive heat therefrom and maintain the temperature of the collector at a suitable operating temperature.

The base of the transistor 120 is connected to a resistor 122 which is in series connection with a parallel arrangement of a variable resistor 124 and a capacitor 126 connected as shown in FIG. 5. The collector of the transistor 120 and the potentiometer-capacitor parallel connection is connected to a transformer 128 which includes a primary coil 128*a* and two secondary coils 128*b* and 128*c* which are magnetically coupled to the primary coil. The secondary coil 128*c* has one terminal end thereof connected to the resistor 124 and capacitor 126 with the other terminal thereof connected to the collector of the transistor 114.

The other secondary coil 128 is connected to the lead 100 at one terminal thereof and to the collector of the transistor 120 at the other terminal thereof. A capacitor 130 is connected in parallel across the secondary winding 128*b*.

The collector of the transistor 120 is also connected to the reflector 52 by means of the connection of the tabs 120*a* and 52*c* as above described. The bulb 54*a* is energizable by the alternating voltage generated by the blocking oscillator across the winding 128*a* the terminals of which are respectively connected to the spring clips 82 and 106.

As indicated above, the specific nature of the electronic switch and the blocking oscillator are not in and of themselves critical and other means for energy conversion suitable for energizing a fluorescent bulb may be utilized for this purpose. Of importance here is the use of the reflector as a heat sink as well as the electrical connections which permit the electronic circuitry to be disposed within a lightweight housing with the controls and sources of D.C. power input being provided on a removable cover. Also to be noted is the very simple construction of the assembly formed by the connection of the components shown in FIG. 4 which permits the insertion and removal of the assembly into and out of the enclosure 12 for purposes of maintenance and repair.

The operation of the circuit shown in FIG. 5 is well known to those skilled in the art, the power supply applying a D.C. voltage to the electronic switch which in turn converts the D.C. voltage into an alternating trigger signal or pulsating signal which causes oscillation of the blocking oscillator at the frequency in question with sufficient amplitude fluctuations to energize and cause the fluorescent lamp to emit light.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A fluorescent lantern comprising an at least partially transparent elongate enclosure having an open end; a cover removably mounted on said enclosure to cover the open end when mounted on said enclosure; reflector means extending along the length of said enclosure proximate the transparent portion thereof; a fluorescent bulb extending along the length of said enclosure and disposed between said transparent portion and said reflector means whereby said reflector means enhances the amount of light transmitted through said transparent portion; electrical terminal means on said cover connectable to a source of direct voltage; a switch mounted on said cover and connected to said electrical terminal means; circuit means disposed within said enclosure for converting a direct voltage into an alternating voltage suitable for energizing said fluorescent bulb when applied across the latter; electrical contact means for completing and interrupting the electrical continuity between said switch and terminal means and said circuit means when said cover is respectively mounted and removed from said enclosure; said circuit means being controlled by said switch in the mounted condition of said cover to thereby permit energization of said bulb and emission of light through said transparent portion when said terminal means is connected to a source of electrical energy and said switch is moved to the actuating position thereof; said electrical terminal means including a plurality of electrical contacts internally provided at opposite ends of said enclosure for contacting corresponding terminals of storage batteries which are receivable within said enclosure; and a housing receivable within said enclosure for enclosing said circuit means, said housing being positionable at the end of said enclosure opposite to said open end; said contacts being mounted on said housing and on said cover, whereby the storage batteries are insertable into and removable from said enclosure by removal of said cover.

2. A lantern as defined in claim 1, wherein said circuit means includes an output transistor connected to said fluorescent bulb and having a metallic collector tab, and wherein said reflector means comprises an elongate planar metallic member having a tab at one free end thereof, said collector tab being mounted on said reflector tab, whereby the latter serves as a heat sink for removing heat from said output transistor and maintaining the same at a safe operating temperature.

3. A lantern as defined in claim 1, wherein said enclosure has a uniform cross-section along the length thereof, said cross-section having two opposing parallel portions having a predetermined length, a transverse portion extending between said two parallel portions as one end of the latter and having a length less than said predetermined length, and an outwardly curved portion extending between said two parallel portions at the other end of the same to form a convex lens along one side of said enclosure.

4. A lantern as defined in claim 3, wherein at least said convex lens is transparent.

5. A lantern as defined in claim 4, wherein said enclosure is made from a transparent material; and further comprising opaque lining means for lining the interior surfaces of said enclosure associated with said parallel and transverse portions, whereby the interior of said enclosure cannot be viewed through the walls represented by said parallel and transverse portions.

6. A lantern as defined in claim 3, wherein said reflector means comprises a planar member having dimensions corresponding to those of the enclosure wall represented by said transverse portion, said planar member being parallel to said enclosure wall and extending between said other end of said parallel portions where the latter are connected to said curved portion, said lens and said planar member forming an elongate compartment through which said fluorescent bulb extends.

7. A lantern as defined in claim 6, further comprising a pair of transverse parallel support members provided at the opposite ends of said reflector planar member and extending into said elongate compartment; and lamp clips mounted on said support members for receiving the pins of said fluorescent bulb and supporting the same.

8. A lantern as defined in claim 6, further comprising a transverse support member provided at one free end of said reflector planar member proximate said cover; and a transverse circuit board provided at the other free end of said reflector planar member, said support member and at least a support portion of said circuit board extending into said elongate compartment and being provided with means for supporting said fluorescent bulb, said circuit means having electrical components mounted on said circuit board portion which is disposed on the other side of said reflector planar member with respect to said support portion.

9. A lantern as defined in claim 8, wherein said circuit board is a printed circuit board.

10. A lantern as defined in claim 8, wherein said electrical contact means comprises pairs of electrically conductive portions provided on said support member and on said cover, each pair of conductive portions being aligned with and in electrical contact when said cover is mounted on said enclosure.

11. A lantern as defined in claim 10, wherein said circuit means is connected to said conductive portions on said support member by means of lead conductors.

12. A lantern as defined in claim 10, wherein said conductive portions on said cover are connected to said switch and electrical terminal means by means of conductive straps.

13. A lantern as defined in claim 12, wherein the free ends of said straps form said conductive portions on said cover.

14. A lantern as defined in claim 1, wherein said electrical terminal means comprises a male pin connector accessible on said cover.

15. A lantern as defined in claim 1, further comprising locking means for securing said cover to said enclosure to prevent inadvertent separation therebetween.

16. A lantern as defined in claim 1, wherein the lantern may be energized by both internal and external sources of voltage, and wherein said electrical terminal means comprises a common ground terminal connectable to one polarity of the source of voltage, and two separate terminals each connectable to the opposite polarity of the respective source of voltage.

17. A lantern as defined in claim 16, wherein said switch is electrically connected in series with said common ground terminal.

18. A lantern as defined in claim 1, wherein a substantial portion of said enclosure forms a portion of an extruded section of elastomeric material.

* * * * *